US005864732A

United States Patent [19]

Kato

[11] Patent Number: 5,864,732

[45] Date of Patent: Jan. 26, 1999

[54] IMAGE FORMING APPARATUS WHICH SORTS AND EJECTS IMAGE-BEARING SHEETS TO MULTIPLE BINS AND CONTROL METHOD FOR SAME

[75] Inventor: Tomokazu Kato, Toyokawa, Japan

[73] Assignee: Minolta Co., Ltd., Osaka, Japan

[21] Appl. No.: 15,974

[22] Filed: Jan. 30, 1998

[30] Foreign Application Priority Data

Jan. 31, 1997 [JP] Japan ..... 9-018945

[51] Int. Cl.[6] ..... G03G 21/02; G03G 15/00

[52] U.S. Cl. ..... 399/43; 399/85; 399/364; 399/403

[58] Field of Search ..... 399/43, 85, 361, 399/364, 403, 407; 271/287, 288

[56] References Cited

U.S. PATENT DOCUMENTS 4,445,680 5/1984 Kikuchi et al. .

4,974,034 11/1990 Rabb et al. .

5,455,667 10/1995 Hiroi et al. ..... 399/373

5,528,353 6/1996 Ushio et al. ..... 399/364

*Primary Examiner*—Richard Moses

*Attorney, Agent, or Firm*—McDermott, Will & Emery

[57] ABSTRACT

An image forming apparatus such as a copying apparatus capable of executing copy operations with excellent efficiency, when executing multi-sort copying even when there is a large number of document pages or a large number of copy bundles, by executing controls to calculate the number of sorting bins required to accommodate ejected recording sheets per document bundle based on the number of document pages and the sheet accommodation capacity per each bin of a sorter, and calculate the number of copies possible in a single multi-sort copy operation from the total number of bins of the sorter and the number of bins required to accommodate the ejected recording sheets per document bundle, and divide the number of copies in a plurality of multi-sort copy operations when the number of set copy bundles exceeds the number of copies possible in a single multi-sort copy operation.

18 Claims, 12 Drawing Sheets

IMAGE FORMING APPARATUS WHICH SORTS AND EJECTS IMAGE-BEARING SHEETS TO MULTIPLE BINS AND CONTROL METHOD FOR SAME

BACKGROUND OF THE INVENTION

This application is based on application No. 9-18945 filed in Japan, the content of which is hereby incorporated by reference.

1. Field of the Invention

The present invention relates to an image forming apparatus which sorts and ejects image-bearing sheets to multiple bins, and control method for same.

2. Description of the Related Art

Image forming apparatuses, and particularly widely used copiers, are usually provided with sorters to sort and eject recorded copy sheets in predetermined number of sheets per unit in accordance with multi-purpose use and popular copying apparatus.

When, for example, when making ten copies of a thirty-page document while sorting said copies into ten individual units using the aforesaid copying apparatus provided with a sorter, each document page is copied ten times and each said copy sheet is ejected to a sorting bin until ultimately one complete copy of the entire thirty-page document is in each sorting bin (hereinafter, this process of copying a document in plurality and sorting said copies in a predetermined number of bundle units is referred to as "multi-sort copying").

There is a limit to the number of recording sheets which can be ejected to a single sorter bin due to the holding strength said sorting bin and the spacing of said bin with adjacent sorting bins. When this holding capacity is, for example, 50 sheets and the number of sheets of a single copy bundle exceeds said number, the copy operation must be stopped at the point at which the bin capacity is reached. Conventionally, the number of recording sheets ejected to each sorting bin is counted, and when the bin capacity limit is attained, controls are executed so as to eject the remaining recording sheets to an empty bin.

In conventional sorting controls such as the aforesaid, uses a plurality of bins to eject a copy of a single document bundle and the number of bins required for multi-sort copying may exceed the total number of sorting bins.

That is, when making fifteen copies of an 80-page document using a sorter in which each bin has a 50-sheet holding capacity, two bins are required for a single copy bundle because the number of copy pages of a single bundle (i.e., 80 pages) exceeds the 50-sheet capacity of a single sorting bin, therefore a total of $2\times15=30$ sorting bins are required for the all the multi-sort copies. If the total number of all sorting bins is 20, then the first 50 sheets are ejected to the first through fifteenth sorting bins, and the 51st and subsequent sheets are ejected sheet by sheet in the sixteenth and subsequent empty sorting bins, but after ejecting copies to the 20th sorting bin the copy operation is terminated because there are no more empty sorting bins.

In this instance, an operator must remove the ejected recording sheets from each bin, resets the 51st and subsequent documents in an auto document feeder, and restart the copy operation, thereby producing a severely adverse effect on operational characteristics, and markedly reducing copy operation efficiency.

SUMMARY OF THE INVENTION

An object of the present invention is to provide an improved image forming apparatus and control method for same which eliminates the previously mentioned disadvantages.

Another object is to provide a copying apparatus capable of executing copy operations with excellent efficiency when executing multi-sort copying even when there is a large number of document pages or a large number of copy bundles.

These objects are attained by providing an image forming apparatus comprising:

an image forming unit to execute image forming operation of forming images on recording sheets based on document images, sort and eject said image-bearing sheets to a plurality of bins of a sorter incorporated with or connected to said image forming apparatus;

a processing unit to execute processes of i) calculating the number of bins required to accommodate image-bearing sheets per image-forming bundle relative to set number of document pages based on the number of sheets accommodatable per bin of said sorter;

ii) calculating possible number of image-forming bundles that can be formed in one image forming operation based on said calculated number of bins and the total number of bins provided to said sorter; and iii) controlling said image forming unit so as to execute said image forming operation dividing into a plurality of times when the set number of image forming bundles exceeds said calculated possible number of image forming bundles.

The aforesaid image forming apparatus may be provided with a document number setting unit to set said number of document pages, and a bundle number setting unit to set said number of image forming bundles. The aforesaid processing unit may obtain the number of bins required to accommodate the ejected image-bearing sheets per image forming bundle by dividing the set number of document pages by the number of sheets accommodatable per bin of said sorter, and may obtain the possible number of image forming bundles by dividing the total number of bins provided to the sorter by said calculated number of bins.

The aforesaid image forming apparatus may also be provided with an image reader to read said document at a predetermined reading position, and auto document feeder to transport and position said document at said reading position. It is desirable that this auto document feeder is of the circulation type to retransport the document read by said image reader at said reading position and position said document at said reading position again.

The aforesaid image forming apparatus may be connected to a network so as to form images on recording sheets based on document image data received through said network.

The aforesaid objects are attained by providing a copying system comprising:

a copying apparatus; and a finisher either connected to or incorporated in said copying apparatus, said finisher having a plurality of bins to sort the recorded sheets ejected from said copying apparatus;

wherein said copying apparatus includes document number setting unit to set the number of document pages to be copied;

copy bundle number setting unit to set the number of copy bundles;

copy unit to execute copy operations of reading document images and copying said images to copy sheets, and sorting and ejecting said image-copied sheets to a plurality of bins of said finisher; and a processing unit to execute processes of i) calculating the number of bins required to accommodate the image-copied sheets per copy bundle relative to the number of document pages set by said document number setting unit based on the number of sheets accommodatable per bin of said finisher;

ii) calculating possible number of copy bundles that can be formed in one copy operation based on said calculated number of bins and the total number of bins provided to said finisher; and iii) controlling said copy unit so as to execute said copy operation dividing into a plurality of times when the number of copy bundles set by said copy bundle number setting unit exceeds said calculated possible number of copy bundles.

In the aforesaid copying system, the processing unit may obtain the number of bins required to accommodate the image-copied sheets per copy bundle by dividing the number of document pages set by the document number setting unit by the number of sheets accommodatable per bin of said finisher, and obtain the possible number of copy bundles by dividing the total number of bins provided to the finisher by the calculated number of bins.

When the aforesaid copying apparatus is capable of reading images on both sides of a document and/or copying on both sides of a copy sheet and a multi-copy mode can be selected to combine the reading of a document image and copying to a copy sheet, the aforesaid processing unit may obtain the number of image-copied sheets per copy bundle from the number of document pages set by the document number setting unit and the selected copy mode, and divide the number of calculated image-copied sheets by the number of sheets accommodatable per bin of the finisher so as to obtain the number of bins required to accommodate the image-copied sheets per copy bundle. In this instance, the multi-copy mode may include a first mode to read images on both sides of a document and copy said respective images on both respective sides of a single copy sheet, a second mode to read an image on one side of a document and copy said image on one side of a copy sheet, a third mode to read the images on both sides of a document and copy said respective images on one side of two respective copy sheets, and a fourth mode to read images on one side of two documents and copy said respective images on both respective sides of a single copy sheet.

BRIEF DESCRIPTION OF THE DRAWINGS

These and other objects and features of the present invention will become apparent from the following description taken in conjunction with the preferred embodiments thereof with reference to the accompanying drawings in which.

DETAILED DESCRIPTION OF THE PREFERRED EMBODIMENTS

The preferred embodiments of the present invention are described hereinafter with reference to the accompanying drawings.

(1) General Construction of Analog-type Copying Apparatus

Figure 1:
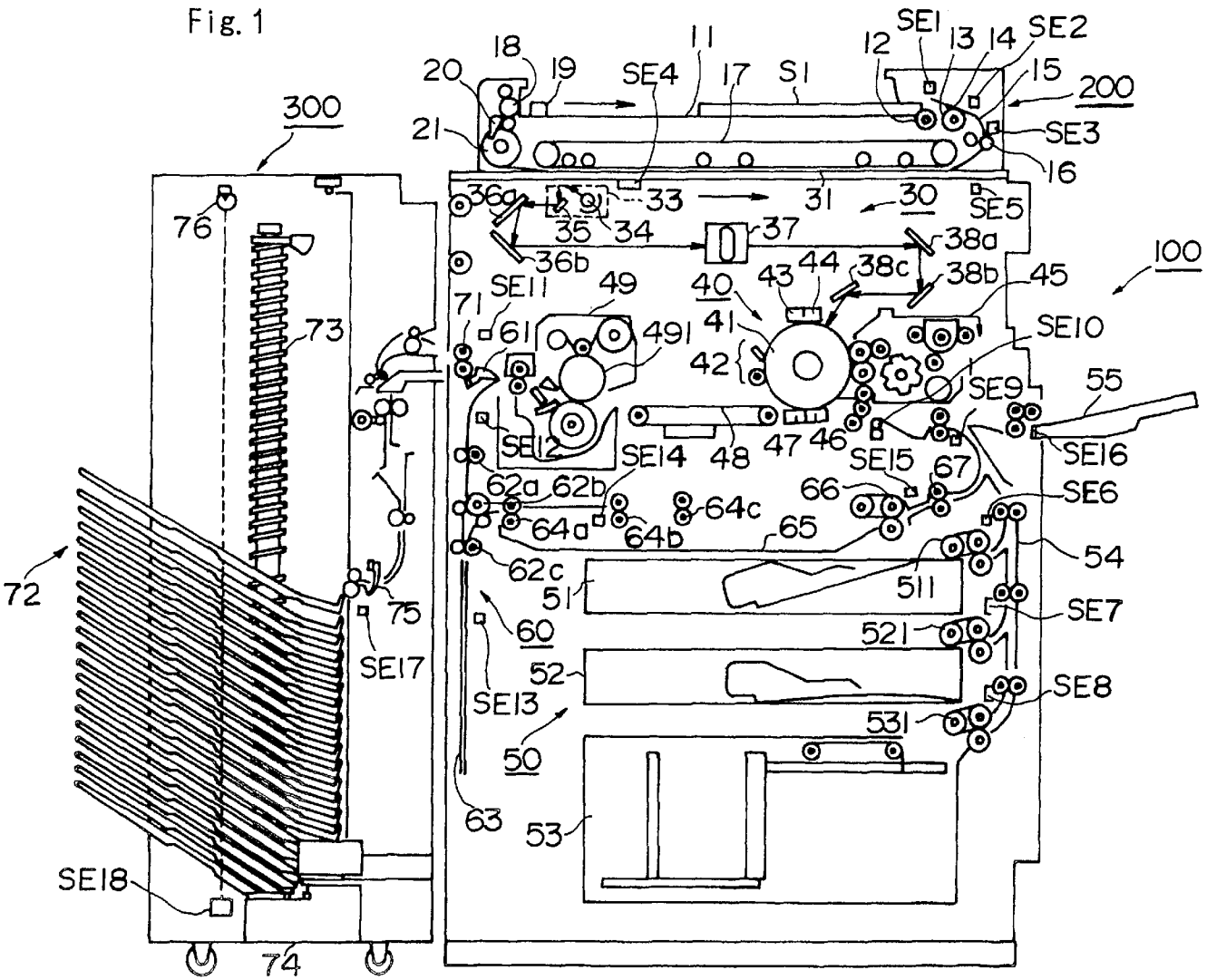
FIG. 1 briefly shows the general construction of a copying apparatus of one embodiment f the present invention.

The general construction of an analog-type copying apparatus (hereinafter referred to simply as "copying apparatus") related to the present invention is described below with reference to FIG. 1.

As shown in the drawing, the copying apparatus comprises a copier body 100 provided with a circulation-type auto document feeder (hereinafter referred to as "ADF") 200 and a sorter 300.

ADF 200 is a device that circulates documents and automatically transports one sheet of the documents at a time to the document platen 31 of copier body 100; a document bundle S1 is placed at the feed opening of document feed tray 11, and the lowermost sheets are separated from said bundle one sheet at a time by means of feed roller 12, separation roller 13, and separation pad 14 so as to be transported along a guide 15 to a document reading position on document platen 31 via registration roller 16 and transport belt 17.

The document transported to the document reading position is scanned by a scanner 33 of copier body 100, and subsequently transported again in a leftward direction in the drawing via transport belt 17, and is ejected to a left part of document feed tray 11 via a discharge roller 18.

When scanning the back side of the document, the document transport path is switched to an inversion roller 21 side via switching member 20 before said document is discharged, and the document is inverted by said inversion roller 21 and transported again to the document reading position of document platen 31 via transport belt 17. When the back side of the document has been scanned, said document is ejected to the left part of document feed tray 11 via the aforesaid discharge operation, and the next document set at the feed opening of the document feed tray 11 is transported to the document reading position thereby exchanging the documents.

Reference number 19 in the drawing refers to a movable projection which is driven in the arrow direction in the drawing via a drive mechanism not shown in the illustration so as to push a document ejected to the left part of document feed tray 11 so as to feed the document to the feed opening again.

Reference number SE1 refers to a document sensor to detect the presence/absence of a document at the feed opening of document feed tray 11; reference numbers SE2 and SE3 are sensors to detect the state of transport of a document.

Copier body 100 comprises a document scanning unit 30, image forming unit 40, paper supply unit 50, and refeeding unit 60.

Document scanning unit 30 is provided with a scanner 33 which is driven by a scanner motor (not illustrated) beneath the document platen 31 so as to move in the arrow direction in the drawing. Scanner 33 is provided with an exposure lamp 34, and a mirror 35 which reflects the light reflected from a document illuminated by said exposure lamp 34 in a direction parallel to document platen 31, such that the light reflected from said document irradiates the surface of a photosensitive drum 41 of image forming unit 40 via mirrors 36*a* and 36*b*, condensing lens 37, and mirrors 38*a*, 38*b*, and 38*c*.

Image forming unit 40 is a device to form an image on a recording sheet using well known electrophotographic art. Before the aforesaid exposure, the residual toner remaining on the surface of photosensitive drum 41 is removed by cleaning unit 42 and residual charge is discharged therefrom via exposure by eraser lamp 43, and the surface of said drum is uniformly charged by charger 44, such that when uniformly charged surface of drum 41 is irradiated via the aforesaid exposure by reflected document light, and electrostatic latent image is formed on the surface of photosensitive drum 41. This electrostatic latent image is developed as a toner image via developing device 45.

Figure 4:
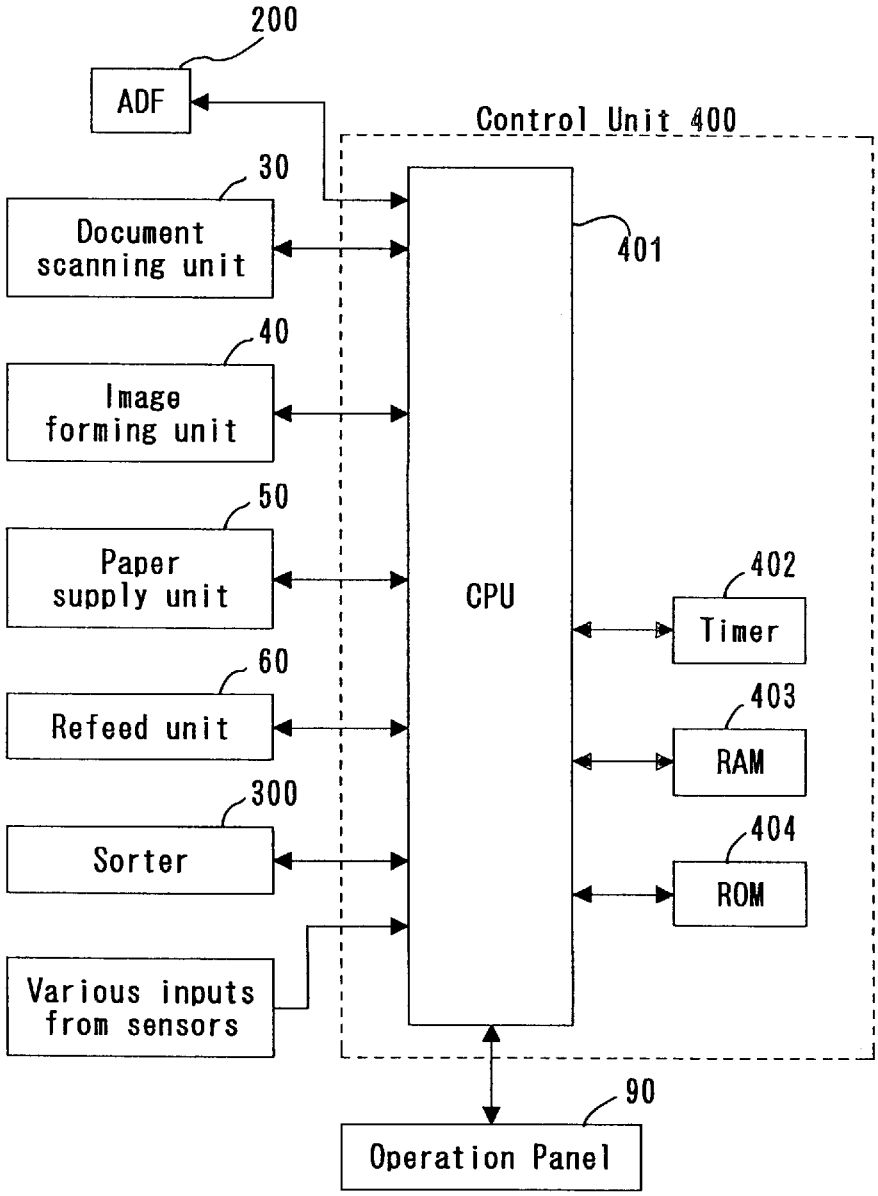
FIG. 4 is a block diagram of the control unit of the copying apparatus of the present embodiment.

On the other hand, paper supply unit 50 is provided with three paper cassettes 51, 52, 53, and the size of the recording sheets accommodated in said cassettes is detected by an optoelectric type sheet size sensor (not illustrated) which transmit detection signals to control unit 400 (FIG. 4).

Synchronously with the image forming operation of photosensitive drum 41, a recording sheet of the required size is fed from one of the paper cassettes 51, 52, or 53, via the drive of either feed roller 511, 521, or 531 so as to pass through the feed path 54 and be transported beneath the photosensitive drum 41, whereupon the toner image formed on the surface of photosensitive drum 41 is transferred onto the surface of said recording sheet via an electrostatic force supplied by transfer charger 46.

Thereafter, the recording sheet is separated from the surface of photosensitive drum 41 by a separation charger 47, and transported to a foxing device 49 by transport belt 48, and the toner image is fused onto said recording sheet via pressure and heat by fixing roller 491 supplied with a built in heater. After fixing, the recording sheet is delivered to sorter 300 via discharge roller 71.

Sorter 300 is provided with a plurality of sorting bins 72 supported so as to be vertically movable via a guide rail (not illustrated), and sorting bins 72 are moved vertically in one direction and an opposite direction via the screw action of a bolt-like-column 73 which is drive in rotation by a drive mechanism 74, such that the sorting bin 72 positioned at discharge opening 75 is sequentially changed to sort the discharged recording sheets when a predetermined sorting operation is executed. Sorter 300 may be a separate unit from the copier body 100 or may be integrated with said copier body 100.

When copying on the second side of a recording sheet, the transport path is changed by moving the leading edge of a switching member 61 upward via a solenoid (not illustrated), so as to guide a recording sheet ejected from fixing device 49 toward the refeeding unit 60. After the recording sheet entering this change feed path is once pulled into a switchback path 63 by transfer rollers 62*a*, 62*b*, 62*c*, said transfer rollers 62*b* and 62*c* reverse rotate and the refed recording sheet is accommodated in intermediate tray 65 via transfer rollers 64*a*, 64*b*, 64*c*.

When copying on the first side of a predetermined number of copy sheets has been completed, the document for first side is ejected to document feed tray 11 by ADF 200, and the next document for second side is fed onto document platen 31, and scanning begins. Synchronously with this scanning operation, recording sheet bearing the first side copy is refed from the intermediate tray 65 to the transfer position under photosensitive drum 41 by feed roller 66 and transfer roller 67, and copying to the second side of said recording sheet is executed.

Thereafter, the recording sheet copied on two sides passes through fixing device 49 and discharge roller 71 and is ejected to sorter 300, and the previously described sorting process is executed.

In copier body 100, reference number SE4 refers to a document size sensor to detect the presence/absence and size of a document on document platen 31; reference number SE5 refers to an ADF sensor to detect the ADF 200 connected to copier body 100, and reference numbers SE6–SE16 refer to sensors to detect the feed state and transport state of a recording sheet at predetermined locations; paper jams and the like are detected via the detection signals of the aforesaid sensors SE6–SE16. Sensors SE6–SE8 and SE15 detect the presence/absence of a recording sheet at the feed openings of paper cassettes 51–53 and intermediate tray 65. Sensor SE14 detects the recording sheets recorded on one side which are accommodated in intermediate tray 65.

In sorter 300, sensor SE17 is a discharge sensor to detect whether or not a recording sheet has been discharged to sorter bin 72. Sensor SE18 is a sorter bin sensor to detect the presence/absence of a recording sheet in sorter bin 72; detection light emitted from lamp 76 (broken line in the drawing) passes through the through-holes (not illustrated) provided in each sorter bin and is received by sorter bin sensor SE18, such that when a recording sheet is in any of the sorter bins 72 the detection light is blocked by said recording sheet and the output of the sorter bin sensor SE18 is reduced, thereby allowing the presence of a recording sheet in sorter bin 72 to be detected.

Figure 2:
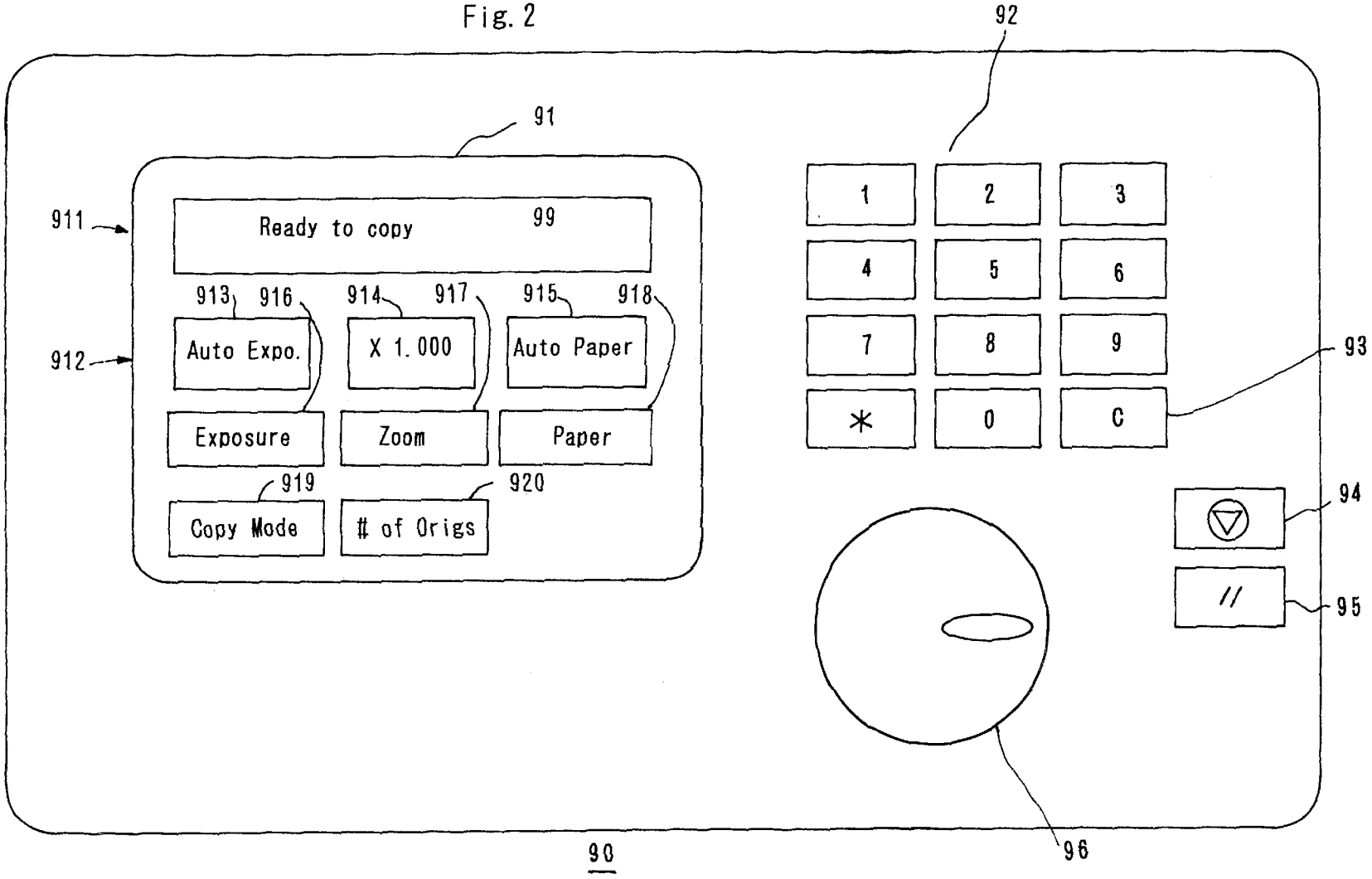
FIG. 2 shows an example of the construction of the operation panel of the copying apparatus of the present embodiments.

The operation panel 90 shown in FIG. 2 is provided at an easily accessible location on the front of copier body 100. Operation panel 90 of the same drawing is provided with a liquid crystal touch panel 91 to display various modes, ten-key pad 92 to input the number of copy sheets and copy magnification and the like, clear key 93 to reset the copy number to the standard value [1], panel reset key 94 to return the various condition set in the copying apparatus to standard values, stop key 95 to stop a copy operation, and print key 96 to start a copy operation.

Liquid crystal touch panel 91 comprises a touch panel overlaid on the display screen of a liquid crystal panel, and is provided with a message display 911 and touch key display 912.

The message display 911 displays, in addition to the copy number, various messages to facilitate operation of the apparatus, and information relating to abnormal operational states such as paper jam warning, insufficient recording sheet supplies and the like. The touch key display is provided with touch keys 916–920 to set the density and copy modes, and predetermined input can be entered by touching the display of the appropriate touch key. 913–915 display the setting states.

Figure 3:
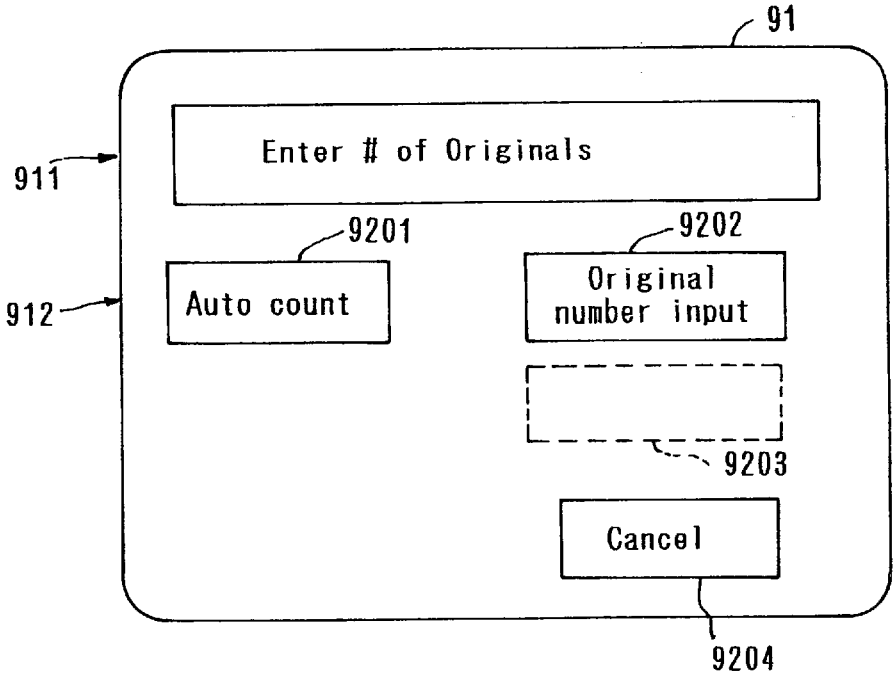
FIG. 3 shows an example a copy mode setting screen and document number input screen displayed on a liquid crystal display of the operation panel of the copying apparatus of the present embodiment.
Figure 3:
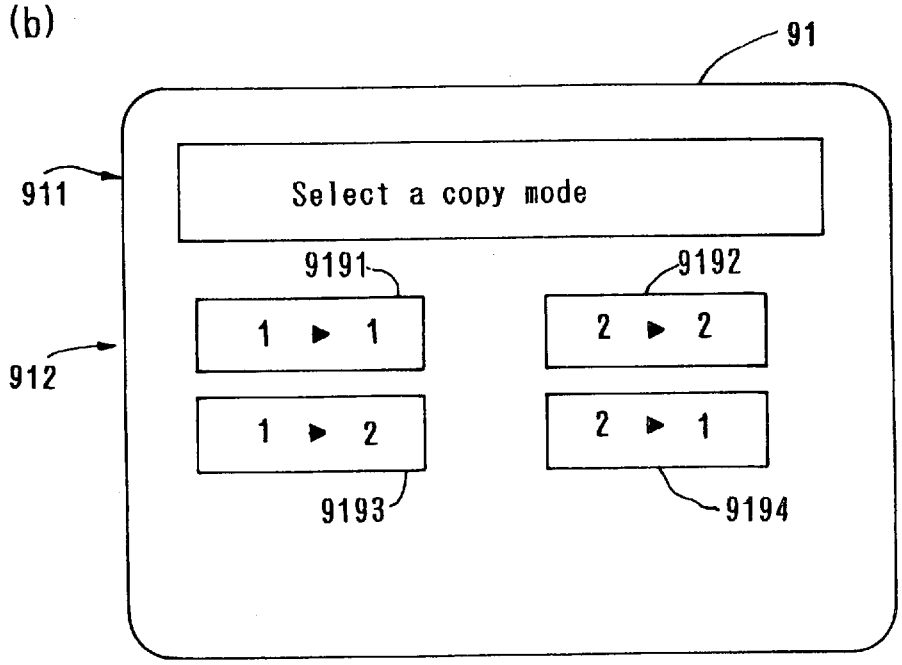

For example, if document number key 920 is touched, the display screen changes from the basic screen of FIG. 2 to the document number input screen of FIG. 3(*a*); if the document count mode key 9201 in this screen is touched, the document number count mode is set to circulate the document in ADF 200 to automatically count the number of documents, whereas if the document number input mode key 9202 is touched, the document number input mode is set to allow numerical input from ten-key pad 92. The number of documents counted or set by the aforesaid key operations is displayed on numerical display 9203, and the display returns to the standard screen by touching the cancel key 9204.

When the copy mode key 919 is touched in the standard screen of FIG. 2, the standard screen is changed to the copy mode input screen shown in FIG. 3(*b*), and the combination of the mode of document reading and the mode of image formation on the recording sheet (i.e., the copy mode) described later can be set by touching the various keys 9191–9194 on this screen.

The construction of control unit 400 provided in the aforesaid copier body 100 is described below with reference to the block diagram of FIG. 4.

As shown in the drawing, control unit 400 comprises a central processing unit (CPU) 401, timer 402, random access memory (RAM) 403, and read only memory (ROM) 404.

Timer 402 clocks the time of the routines for the time management process. RAM 403 temporarily stores various control flags, the copy bundle number set by operation panel 90, and other content of copy conditions. ROM 404 stores initialization values and control programs required for the copy operation.

CPU 401 reads out the required control programs from ROM 404 based on the instructions entered by operation panel 90, and controls the various operations of the document scanning unit 30, image forming unit 40, paper supply unit 50 and refeed unit 60, as well as sorter 300 and ADF 200 to execute smooth copy operations, and controls the display screens and the like of liquid crystal display 91 of operation panel 90.

CPU 401 also receives input from sensors SE1–SE18 and determines the control timing via said detection signals, or confirms the presence/absence of recording sheets in paper cassettes 51–53, and detects paper jams and the like in each transport path.

(2) Control Operation of Control Unit 400

Figure 5:
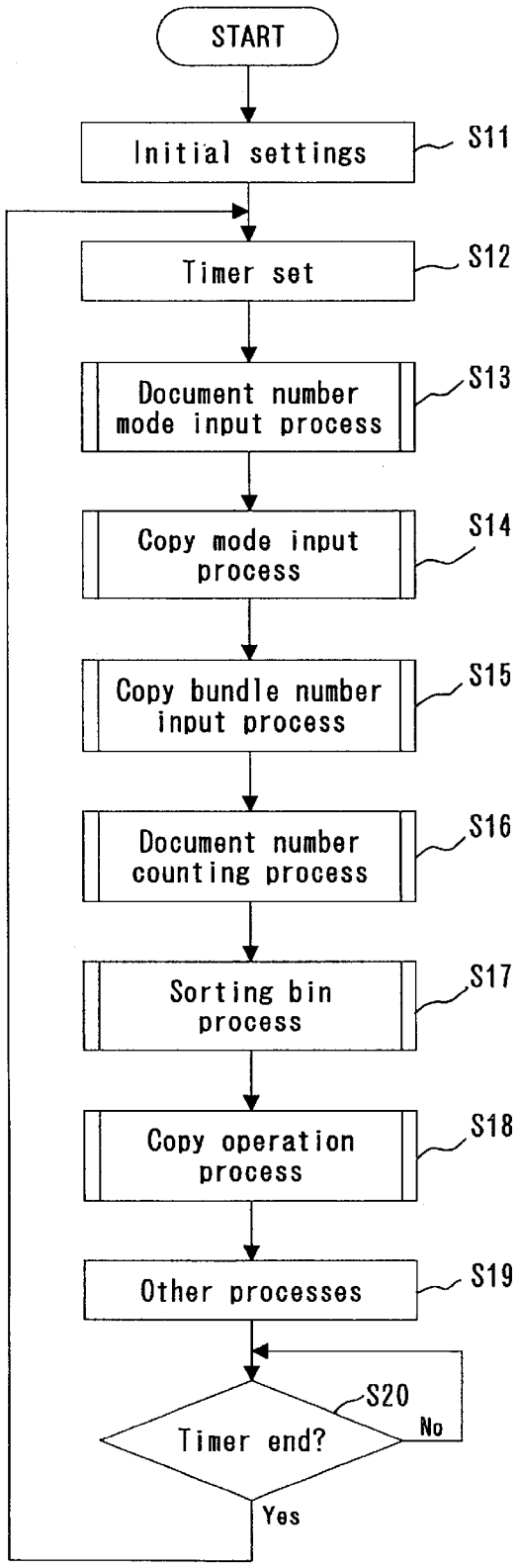
FIG. 5 is a flow chart of the main routine of the control operation of the control unit of the copying apparatus of the present embodiment.

FIG. 5 is a flow chart of the main routine of the control operation of control unit 400.

CPU 401, for example, starts processing when power from a power source is supplied to the apparatus. First, initialization is executed to clear the registers in CPU 401 and clear the recorded content in RAM 403 (step S11), and thereafter the loop processes of steps S12–S20 are repeated.

That is, the internal timer is started to manage the execution time of one routine (step S12), the document number mode input process is executed to set the number of documents (step S13), the copy mode input process is executed to set the copy mode (step S14), the copy bundle number input process is executed to set the number of copy bundles (step S15), the document number counting process is executed to count the number of document pages (step S16), the sorting bin process is executed to control the sorting bins that will accommodate image-copied recording sheets by lifting/lowering sorting bins 72 for sorting of the image-copied sheets (step S17), the copy operation process is executed to form an image on a transported recording sheet (step S18), other processes are executed such as control of the display screens of liquid crystal touch panel 91 and control of the scanner drive and the like (step S19), and after executing the aforesaid processes the end of the internal timer is awaited (step S20), whereupon the routine returns to step S12 and the loop process is repeated.

The specific contents of the processes of steps S13–S18 of the main routine are described below.

(2-1) Document Number Mode Input Process

Figure 6:
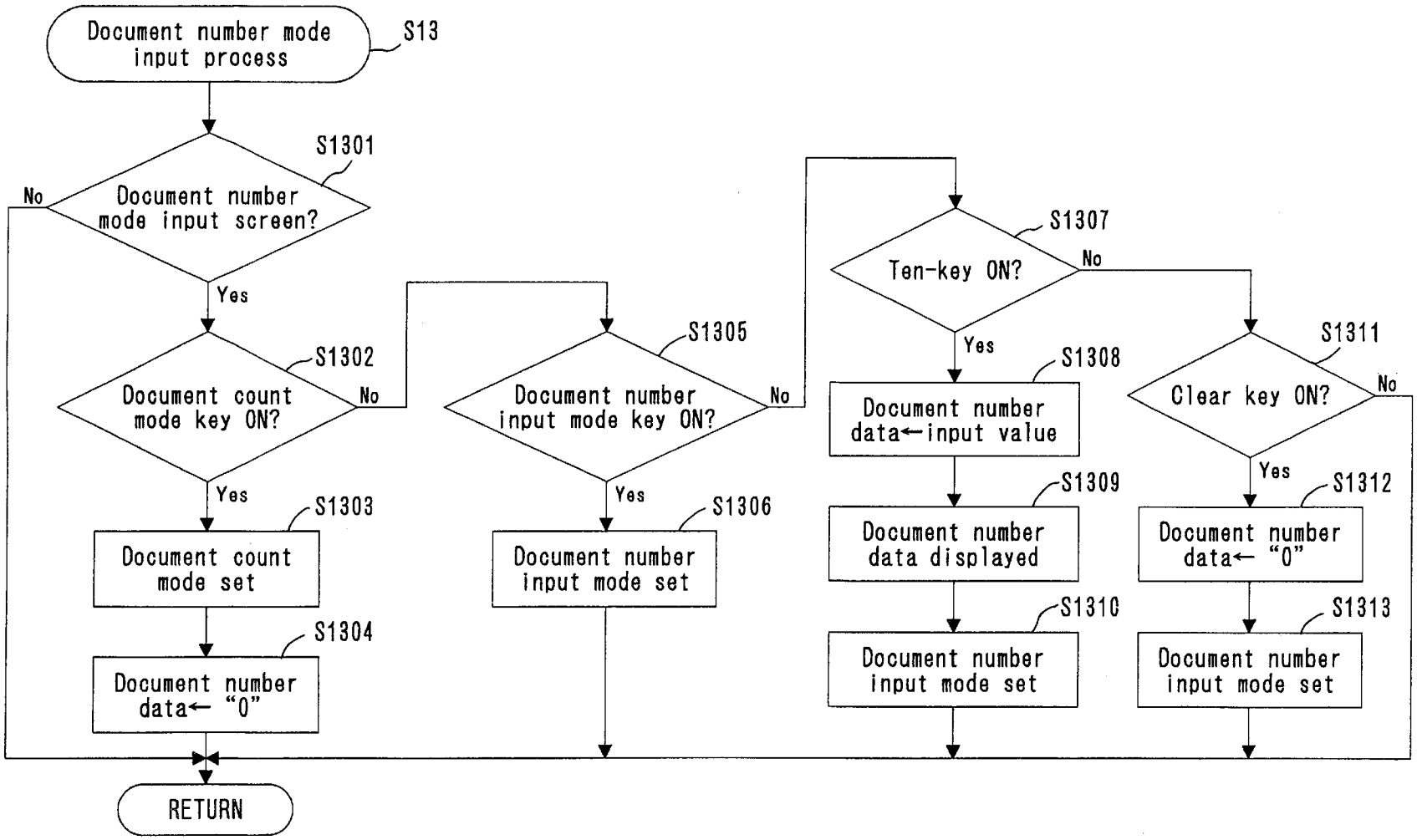
FIG. 6 is a flow chart of the subroutine of the document number mode input process (step S13) of FIG. 5.

FIG. 6 is a flow chart showing the subroutine of the document number mode input process of step S13.

First, a check is made to determine whether or not liquid crystal touch panel 91 of operation panel 90 is displaying the document number input screen (refer to FIG. 3(*a*)) (step S1301). When the document number input screen is set and the document count mode key 9201 is touched, the key output rises from low level (Lo) to high level (Hi), and when this rise (ON-edge) is detected by CPU 401 (step S1302; hereinafter, the detection of the aforesaid ON-edge state by CPU 401 when the various input keys are touched or pressed is referred to simply as "ON"), the mode to set the document number, i.e., document number mode is set to the document counting mode (step S1303), and the document number data stored in RAM 403 is set at [0] (step S1304). Then the routine returns to the main routine. This document counting mode is a mode wherein the number of document pages is automatically counted while the documents are circulated by the ADF 200, and is described in more detail in FIG. 9.

When the document number input mode key 9202 is turned ON rather than the document counting mode key 9201 (step S1302: NO, step S1305: YES), the document number mode is set to the document number input mode (step S1306) and the routine returns to the main routine so as to await input from the ten-key pad 92.

When the ten-key pad 92 is pressed directly with neither the document counting mode key 9201 or document number input mode key 9202 being turned ON (step S1302: NO, step S1305: NO), the input value is set as the document number data (steps S1307, S1308), this numerical value is displayed on numerical display 9203 (step S1309), and the document number mode is set at the document number input mode (step S1310).

When the clear key 93 is turned ON without the document count mode key 9201, document number input mode key 9202, or ten-key pad 92 being turned ON (step S1302: NO, step S1305: NO, step S1307: NO), the document number data stored in RAM 403 is reset to [0] (steps S1311, S1312), the document number mode is set at the document number input mode (step S1313), and input from the ten-key pad 92 is awaited.

(2-2) Copy Mode Input Process

Figure 7:
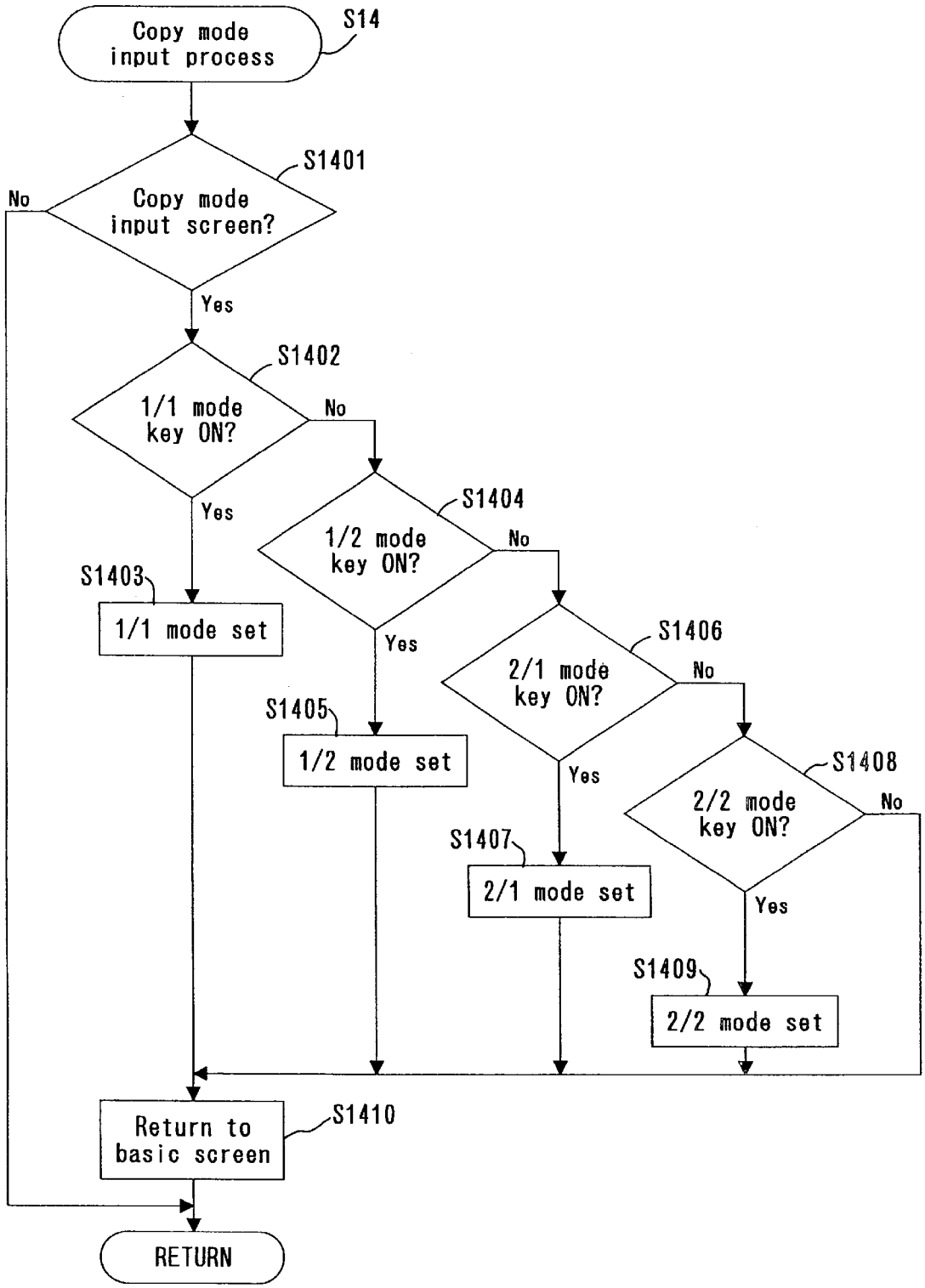
FIG. 7 is a flow chart of the subroutine of the copy mode input process (step S14) of FIG. 5.

FIG. 7 is a flow chart showing the subroutine of the copy mode input process of step S14 of FIG. 5. In this instance, copy mode means the mode of reading documents (i.e., one side reading mode, duplex reading mode) and mode of forming an image on a recording sheet (i.e., one side copy mode, duplex copy mode), e.g., the [one side duplex mode] indicates a copy mode wherein document images are read one side at a time and copies to the front and back sides of a copy sheet.

In the copy mode input process, first, a check is made to determine whether or not the display screen of the liquid crystal display 91 is set at the copy mode input screen (refer to FIG. 3(*b*)) (step S1401). When the display is set at the copy mode input screen, the appropriate copy mode is set by turning ON the corresponding copy mode key 9191–9194.

When the one-side/one-side mode key 9191 is turned ON in the copy mode input screen, the copy mode is set at the one-side/one-side mode (steps S1402, S1403). Similarly, the one-side/duplex mode is set by turning ON the one-side/duplex mode key 9193 (steps S1404, S1405), the duplex/one-side mode is set by turning ON the duplex/one-side mode key 9194 (steps S1406, S1407), and the duplex/duplex mode is set by turning ON the duplex/duplex mode key 9192 (steps S1408, S1409). When any copy mode has been set, the display screen of liquid crystal touch panel 91 returns to the basic screen (step S1410) and the routine returns to the main routine.

(2-3) Copy Bundle Number Input Process

Figure 8:
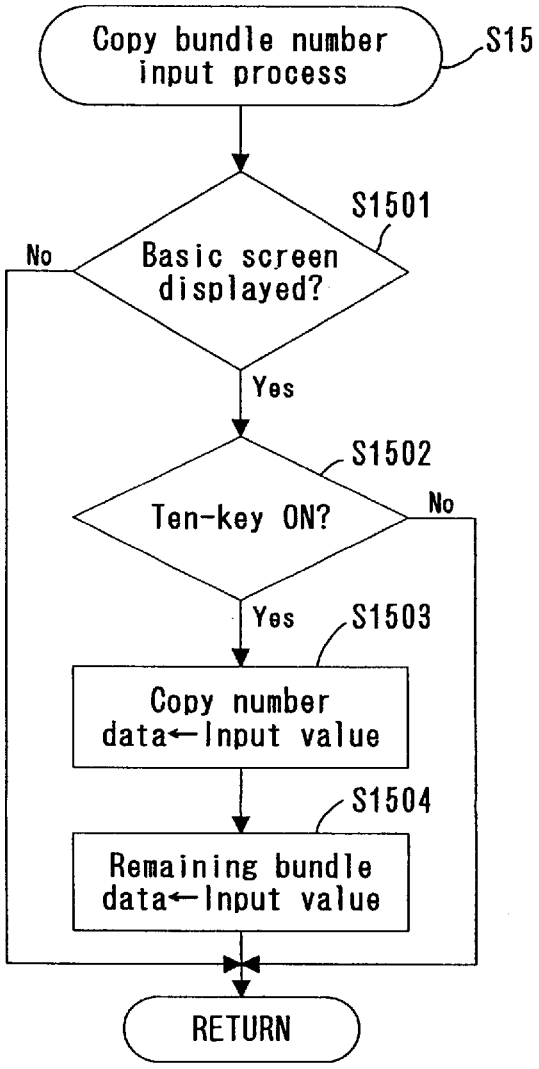
FIG. 8 is a flow chart of the subroutine of the copy bundle number input process (step S15) of FIG. 5.

FIG. 8 is a flow chart showing the subroutine of the copy bundle number input process of step S15 in FIG. 5.

First, a check is made to determine whether or not the basic screen is displayed on liquid crystal touch panel 91 (step S1501). When the basic screen is displayed and the ten-key pad 92 is turned ON (step S1502), the input numerical value is set in the memory area of the copy number data and remaining bundle number data in RAM 403 (steps S1503, S1504) and the routine returns to the main routine.

(2-4) Document Number Counting Process

Figure 9:
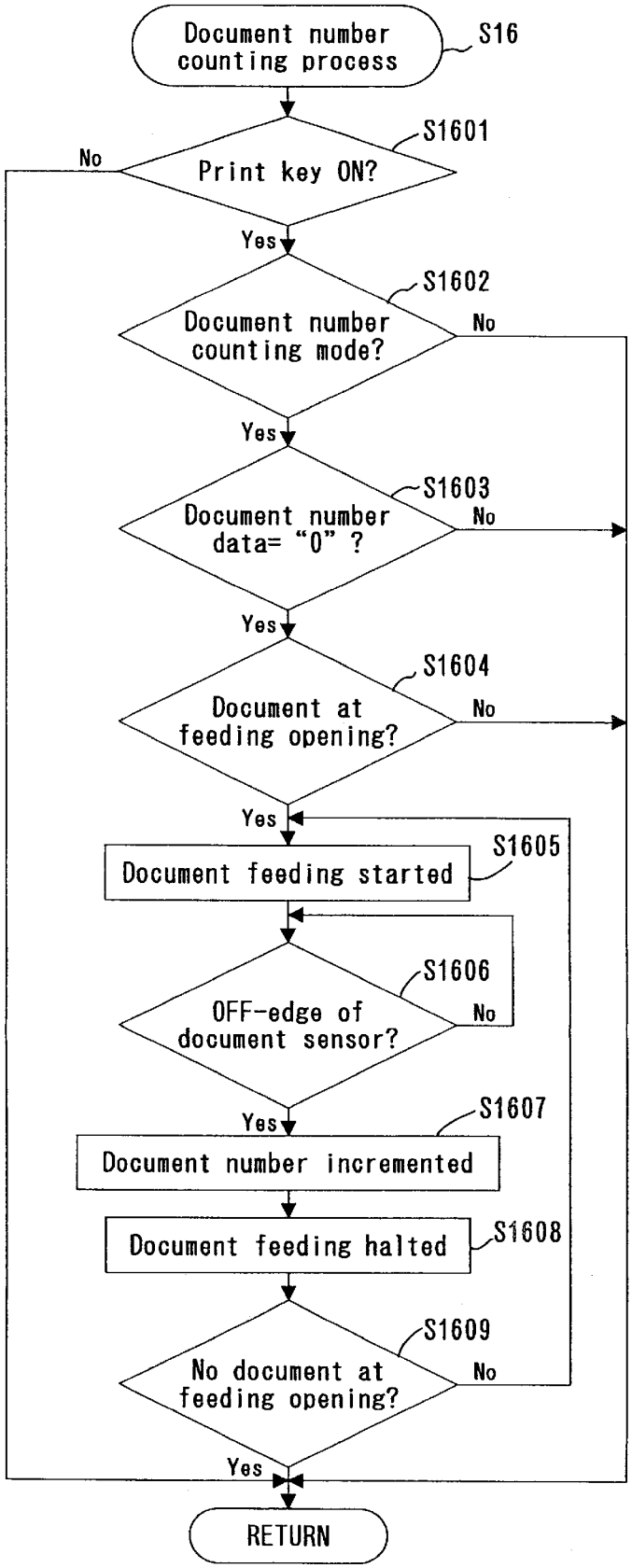
FIG. 9 is a flow chart of the subroutine of the document number counting process (step S16) of FIG. 5.

FIG. 9 is a flow chart showing the subroutine of the document number counting process of step S16 in FIG. 5.

First, a check is made to determine whether or not print key 96 is turned ON (step S1601). When print key 96 has been turned ON, the document number mode is set at the document counting mode, and if the document number data is [0] (steps S1602, S1603), the presence of a document at the feed opening of document feed tray 11 is confirmed by the detection signal of document sensor SE1 (FIG. 1) and insofar as the presence of a document is confirmed, feeding of said document is started (steps S1604, S1605), and the OFF-edge state of said document sensor SE1 is detected (step S1606). This OFF-edge state is the fall of the detection signal of sensor SE1 from high level (Hi) to low level (Lo), and allows the detection of the trailing edge of a fed document.

When this OFF-edge state is detected, feeding of the documents is completed, and the document number count value is incremented by [1] within RAM 403 (step S1607), and thereafter the drive motor of ADF 200 (not illustrated) is stopped to halt the feeding of the documents (step S1608). If a document is remaining in document feed tray 11 at this time (step S1609: NO), the routine returns to step S1605, and the operations of steps S1605–S1608 are repeated to again execute the document feeding and document counting processes, and if no document remains in document feed tray 11 in step S1609 (step S1609: YES), the routine returns to the main routine as all documents have been counted.

(2-5) Sorting Bin Process

Figure 10:
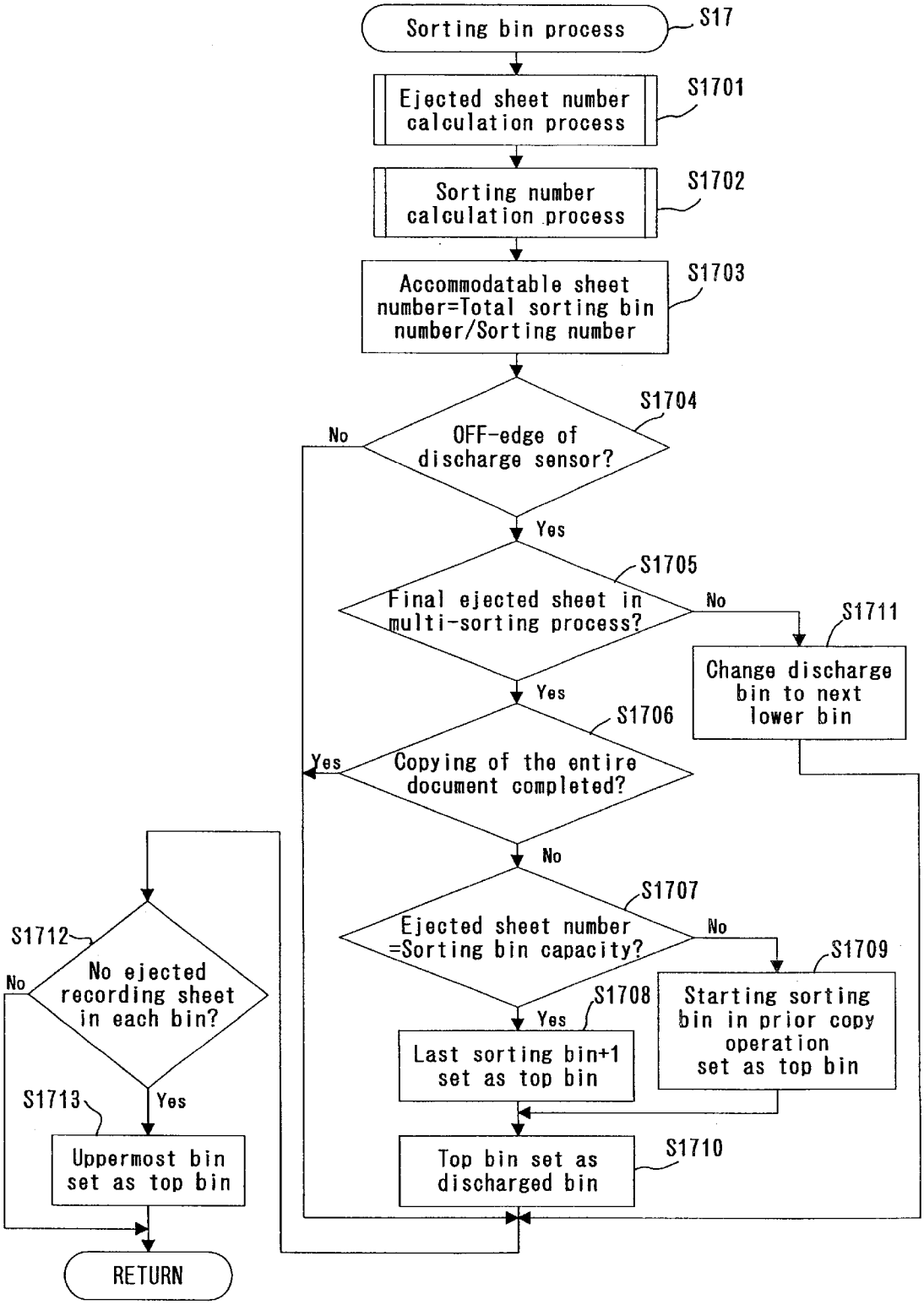
FIG. 10 is a flow chart of the subroutine of the sorting bin process (step S17) of FIG. 5.

FIG. 10 is a flow chart showing the subroutine of the sorting bin process of step S17 in FIG. 5.

First, the number of recording sheets that will be ejected in copying one document bundle is calculated (step S1701).

Figure 11:
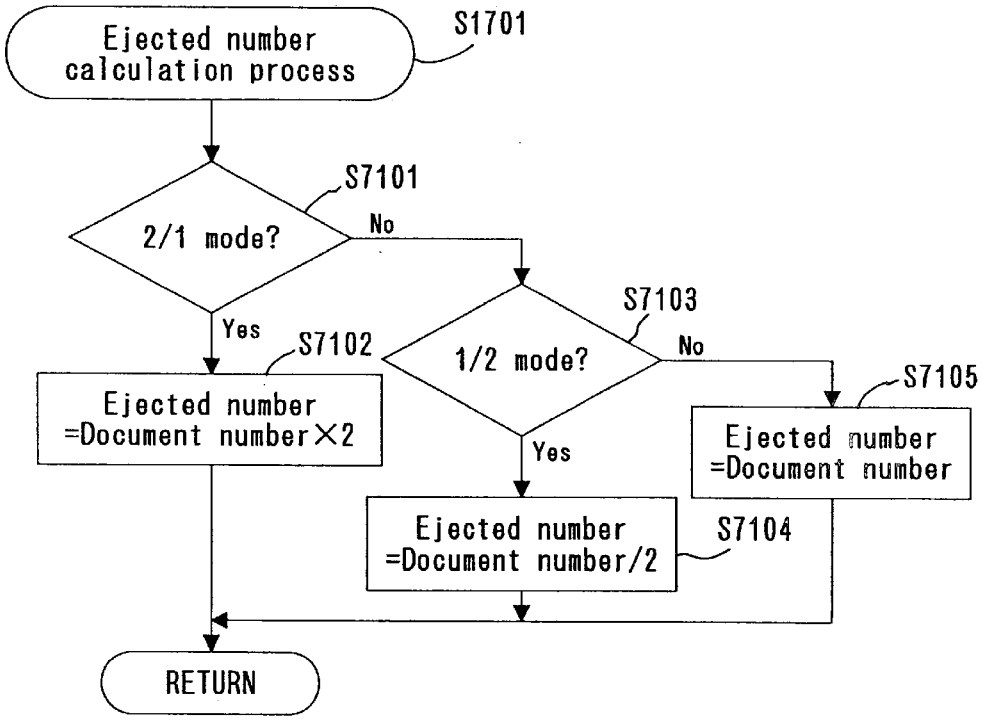
FIG. 11 is a flow chart of the subroutine of the ejected sheet number calculation process (step S1701) of FIG. 10.

FIG. 11 is a flow chart showing the content of the ejected sheet number calculation process. In the previously described copy mode input process (step S14), when the set copy mode is the duplex/one-side mode, the number of ejected sheets required to copy one document bundle is double the number of document pages (steps S7101, S7102), and conversely when the one-side/duplex mode is set, the number of ejected sheets required to copy one document bundle is ½ the number of document pages (in case of an odd number of document pages, the decimal fraction is rounded up to the nearest whole number) (steps S7103, S7104).

When the copy mode is set in neither the duplex/one-side mode nor the one-side/duplex mode (step S7101: NO, step S7103: NO), i.e., when the one-side/one-side mode or duplex/duplex mode is set, the document number is set as the number of ejected copy sheets because the number of documents matches the number of copy sheets used for one copy bundle (step S7105).

For example, if there are 35 document pages, there will be 70 ejected copy sheets in the duplex/one-side mode, 18 ejected copy sheets in the one-side/duplex mode, and 35 ejected copy sheets in the one-side/one side and duplex/duplex modes.

Figure 12:
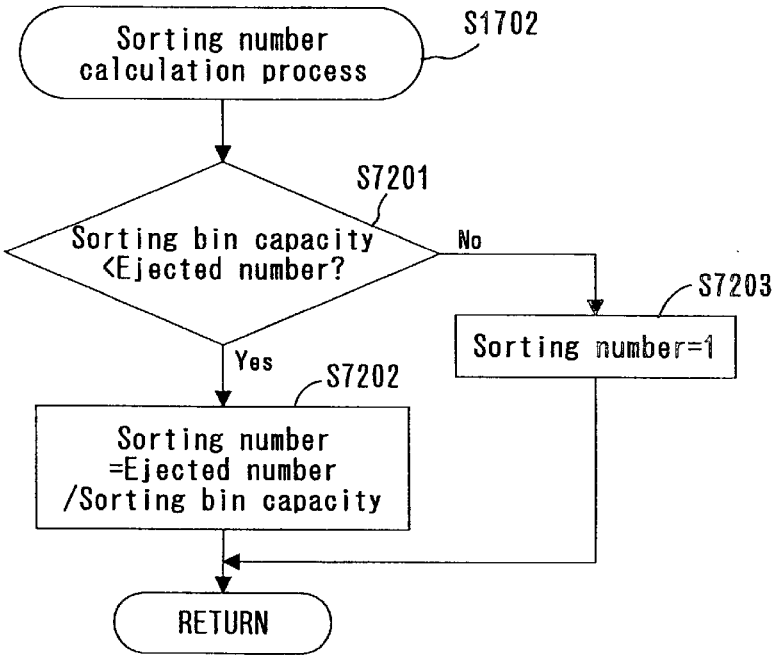
FIG. 12 is a flow chart of the subroutine of the division number calculation process (step S1702) of FIG. 10.

Returning now to FIG. 10, when the ejected sheet number calculation process is executed in step S1701, thereafter the sorting number calculation process is executed to calculate the number of sorting bins required to accommodate the copy of one document bundle (step S1702). In the sorting number calculation process, as shown in the flow chart of FIG. 12, when the number of ejected sheets per document bundle determined by the aforesaid ejected sheet number calculation process is greater than the discharge capacity (sorting bin capacity) of one sorting bin, the number of ejected sheets is divided by the sorting bin capacity (decimal fractions are rounded up to the nearest whole number) to determine the number of needed sorting bins (this value is referred to as "sorting number" because it is the same value the number of sorting bins to which the recording sheets per copy bundle are ejected (steps S7201, S7202). When the number of ejected copy sheets per copy bundle is less than the sorting bin capacity, the sorting number is set at [1] (step S7203).

For example, when the sorting bin capacity is 50 and the document has 35 pages, the sorting number becomes [2] because the number of ejected sheets per copy bundle in the duplex/one-side mode is double the 35 document pages, or 70 copy sheets, whereas in the any other copy mode, the sorting number is [1] because the number of ejected copy sheets is less than 50.

Returning now to FIG. 10, when the sorting number calculation process of step S1702 is completed, then the number of copy bundles that can be accommodated in the sorter in a multi-sort copy operation (i.e., number of accommodatable copy bundles) is calculated. The number of accommodatable copy bundles is determined by dividing the total number of sorting bins by the aforesaid sorting number (where decimal fractions are rounded up to the nearest whole number) (step S1703).

After the number of accommodatable copy bundles has been calculated, the copy operation is started, and the recording sheets start to be discharged to the sorting bins sequentially downward from the top bin of the discharge cycle (hereinafter referred to as "top bin"). When the trailing edge of a discharged recording sheet is detected by the OFF-edge state of discharge sensor SE17, a check is made to determine whether or not the ejected sheet is the last sheet in the accommodatable copy bundles per document bundle or the last sheet in the last remaining copy bundle, and whether or not the ejected recording sheet is the final sheet to be ejected in the multi-sorting copy operation (steps S1704, S1705). The last remaining copy bundle is the number of the copy bundles remaining when the set number of copy bundles has been divided by the number of accommodatable copy bundles, i.e., the set number of copy bundles when the set number of copy bundles does not exceed the number of accommodatable copy bundles, and the number of copy bundles to be processed in a final multi-sort copying operation when the number of copy bundles exceeds the number of accommodatable copy bundles.

If the recording sheet detected by the OFF-edge state of discharge sensor SE17 is not the last sheet in the accommodatable copy bundles per document bundle or the last sheet in the last remaining copy bundle, the discharge bin is changed to the next lower bin and the ejection of the next recording sheet is awaited (step S1711).

On the other hand, when the ejected recording sheet is the last sheet in the accommodatable copy bundles per document bundle or the last sheet in the last remaining copy bundle, a check is made to determine whether or not copying of the entire document has been completed (step S1706). If copying of the entire document is not completed, the copying process continues for the next document, and if the number of ejected recording sheets is equal to the capacity of one sorting bin (step S1707: YES), the sorting bin next to the last used sorting bin (i.e., the last sorting bin+1) is set as the top bin. If there is excess capacity remaining in the used sorting bins, the sorting bin which started the recording sheet discharge in the immediately prior copy operation is set as the top bin (step S1707: NO, S1709). Then sorting bin to be discharged is set to the set top bin (step S1710).

At the end of the sorting bin process, the presence/absence of ejected recording sheets in each bin is detected by the detection signals of sorting bin sensor SE18 (step S1712). If an operator removes the ejected recording sheets so as to empty said sorting bins, the uppermost bin (first sorting bin) is set as the top bin (step S1713).

When the copy operation is completed, an audible warning may be generated, and a message requesting removal of the recording sheets from the sorting bins 72 may be displayed on the message display 911 of liquid crystal touch panel 91 so as to improve operational characteristics. Providing a mechanism to automatically remove ejected recording sheets from sorting bins 72 would be advantageous.

(2-6) Copy Operation Process

Figure 13:
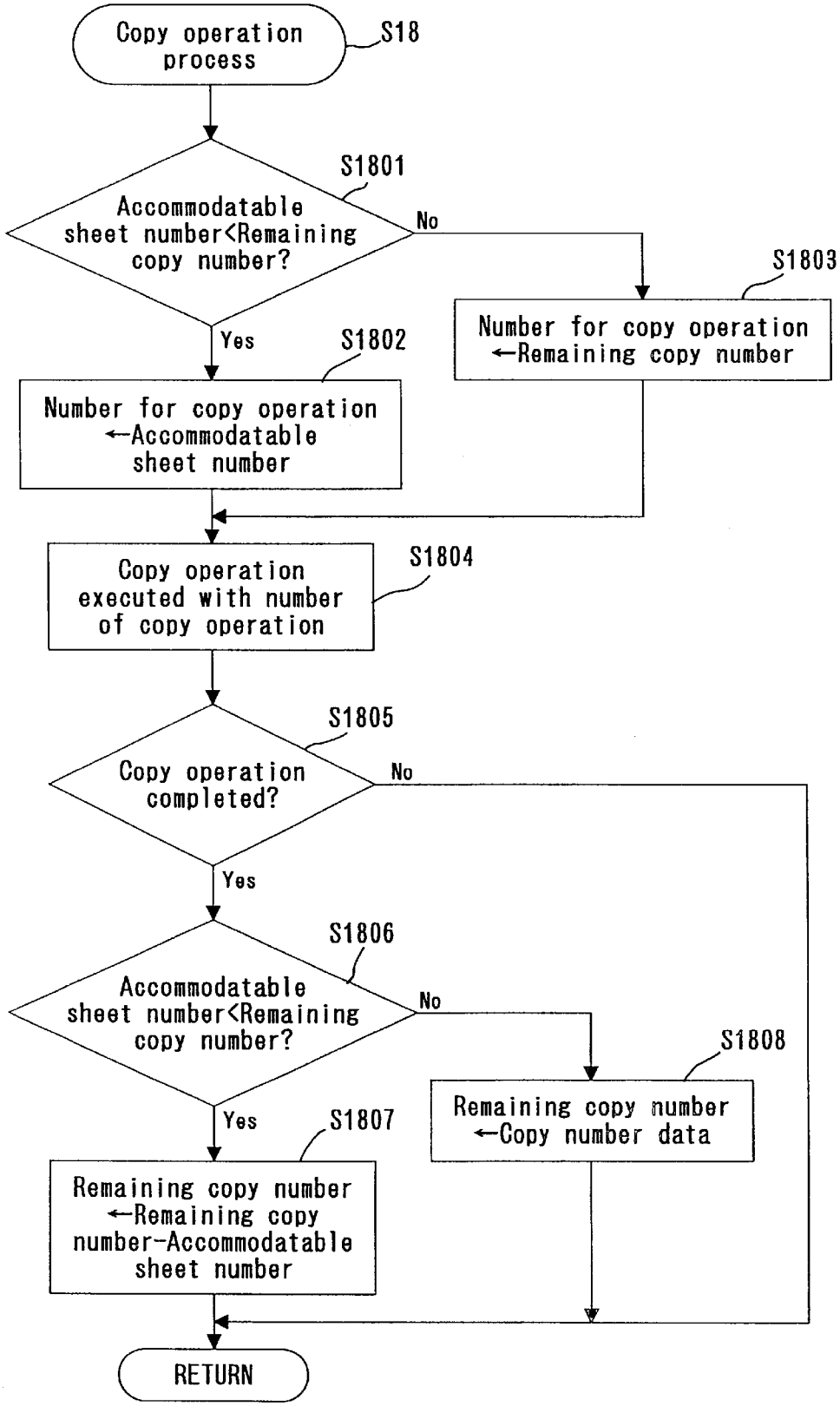
FIG. 13 is a flow chart of the subroutine of the copy operation process (step S18) of FIG. 5.

FIG. 13 is a flow chart showing the subroutine of the copy operation process of step S18 in FIG. 5.

First, the remaining copy number data set in RAM 403 is confirmed and the remaining copy number is compared with the number of accommodatable copy bundles (step S1801). If the remaining copy number exceeds the number of accommodatable copy bundles, the number of accommodatable copy bundles is set as the number used for the copy operation in RAM 403 (step S1801: YES, step S1802).

On the other hand, if the remaining copy number is less than the number of accommodatable copy bundles, since the entire number can be processed in a single multi-sort copy operation, remaining copy number is set as the number used for the copy operation (step S1801: NO, step S1803).

After the number for the copy operation has been set, the copy operation is executed until copying is completed for the number set for the copy operation (step S1804). That is, documents are fed to the document scanning unit 30 one sheet at a time by ADF 200, and each document is scanned in accordance with the number set for the copy operation to copy said document pursuant to the set copy mode and execute the multi-sort copying operation in combination with the sorting bin process which has been previously described.

When copying has been completed for the number set for the copying operation, the number of accommodatable copy bundles is compared with the number of remaining copies (step S1805: YES, step S1806), and when the number of remaining copies is larger, the number of accommodatable copy bundles is subtracted from the number of remaining copies and that value is set as the number of remaining copies (step S1806: YES, step S1807). When the number of remaining copies is smaller, the initially set number of copy bundles is input as the remaining copy number (step S1806: NO, step S1808), and the copy operation process ends.

(3) Although the present invention has been fully described in connection with the preferred embodiments thereof with reference to the accompanying drawings, it is to be noted that various changes and modification will be apparent to those skilled in the art. Such changes and modifications are to be understood as being included within the scope of the present invention as defined by the appended claims unless they depart therefrom.

Several modification are described below.

(3-1) Although the copying apparatus of the previously described embodiment is provided with a circulation-type automatic document feeder 200, a normal automatic document feeder may be used. In this instance, when an operator removes recording sheets from the sorting bins, a copy operation for the remaining copy number is restarted by resetting the documents on the document feed tray 11 and pressing the print key 96.

While the copying apparatus in the aforesaid embodiment is an analog type, the present invention may be applied to copying apparatus of the digital type. In digital type copying apparatus, image data of each page can be stored in a single cycle of document reading/scanning insofar as the memory capacity used to store the read data is large enough, and in which case document circulation and reading is unnecessary.

(3-2) In the aforesaid embodiment, when a copy number set by an operator is greater than the number of accommodatable copy bundles in a single multi-sort copy operation, the copy operation is performed a plurality of times for the number of accommodatable copy bundles, with a multi-sort copy operation executed for the final remaining number of copies. However, the first multi-sort copy operation need not be set at the number of accommodatable copy bundles, and copying may be accomplished by distributing the set number of copies in a plurality of multi-sort copy operations.

(3-3) Although the aforesaid embodiment has been described in terms of a stand alone copying apparatus, a digital-type copying apparatus may be connected to a network so as to receive document image data through said network and execute copy operations thereby. In this instance, copy conditions such as the number of document pages and number of copies may be input via the network.

The copying apparatus of the aforesaid embodiment eliminates the disadvantage of conventional apparatus which must stop an on-going copy operation before completion by executing controls to calculate the number of bins required to accommodate ejected recording sheets per document bundle via a bin number calculating unit based on the number of document pages and the sheet accommodation capacity per each bin of the sorter, and calculating the number of copies possible in a single multi-sort copy operation from the total number of bins of the sorter and the number of bins required to accommodate the ejected recording sheets per document bundle, and dividing the number of copies in a plurality of multi-sort copy operations when the number of set copies exceeds the number of copies possible in a single multi-sort copy operation.

Furthermore, the copying apparatus of the aforesaid embodiments is capable of reading duplex documents and copying to both side of a recording sheet, and is provided with a copy mode setting unit to set combinations of the document reading mode and copying mode to the recording sheet, and is capable of executing multi-sort copy operation suitable for the copy mode by calculating the number of copies possible in a single multi-sort copy operation from the total number of sorting bins and the number of bins required to accommodate the ejected recording sheets per document bundle in a set copy mode.

What is claimed is:

1. A copying system comprising:

a copying apparatus; and a finisher connected to or incorporated in said copying apparatus, said finisher having a plurality of bins to sort image-copied sheets ejected from said copying apparatus;

wherein said copying apparatus includes a document number setting unit which sets the number of document pages to be copied;

a copy bundle number setting unit which sets the number of copy bundles; and a copy unit which executes copy operation of reading images of original document and copying said images to copy sheets, and sorting and ejecting the image-copied sheets to a plurality of bins of said finisher; and a processing unit which executes processes of i) calculating the number of bins required to accommodate the image-copied sheets per copy bundle relative to the number of document pages set by said document number setting unit based on the number of sheets accommodatable per bin of said finisher;

ii) calculating possible number of copy bundles that can be copied in one copy operation based on the calculated number of bins and the total number of bins provided to said finisher; and iii) controlling said copy unit so as to execute said copy operation dividing into a plurality of times when the number of copy bundles set by said copy bundle number setting unit exceeds said calculated possible number of copy bundles.

2. A copying system as claimed in claim 1, wherein said processing unit obtains the number of bins required to accommodate the image-copied sheets per copy bundle by dividing the number of document pages set by the document number setting unit by the number of sheets accommodatable per bin of said finisher, and obtains the possible number of copy bundles by dividing the total number of bins provided to the finisher by the calculated number of bins.

3. A copying system as claimed in claim 2, wherein said copying apparatus is capable of reading images on both sides of an original document and/or copying on both sides of a copy sheet, and is capable of selecting one of a plurality of copy modes to combine the reading of an original document image and copying to a copy sheet, and wherein said processing unit obtains the number of image-copied sheets per copy bundle from the number of document pages set by the document number setting unit and the selected copy mode, and divides the calculated number of image-copied sheets by the number of sheets accommodatable per bin of the finisher so as to obtain the number of bins required to accommodate the image-copied sheets per copy bundle.

4. A copying system as claimed in claim 3, said plurality of copy modes includes a first mode to read images on both sides of an original document and copy said respective images on both respective sides of a single copy sheet, a second mode to read an image on one side of an original document and copy said image on one side of a copy sheet, a third mode to read the images on both sides of an original document and copy said respective images on one side of two respective copy sheets, and a fourth mode to read images on one side of two documents and copy said respective images on both respective sides of a single copy sheet.

5. A copying system as claimed in claim 3, further comprising an auto document feeder which transports and positions said original document at a reading position in said copying apparatus.

6. A copying system as claimed in claim 5, wherein said auto document feeder is of circulation type to retransport the original document read at said reading position and position said original document at said reading position again.

7. A method of controlling a copying system comprising a copying apparatus and a finisher connected to or incorporated in the copying apparatus, said copying apparatus executing copy operation of reading images of original document and copying said images to copy sheets, and sorting and ejecting the image-copied sheets to a plurality of bins of said finisher, said method comprising the steps of:

(1) setting the number of document pages to be copied;

(2) setting the number of copy bundles;

(3) calculating the number of bins required to accommodate the image-copied sheets per copy bundle relative to the set number of document pages based on the number of sheets accommodatable per bin of said finisher;

(4) calculating possible number of copy bundles that can be copied in one copy operation based on the calculated number of bins and the total number of bins provided to said finisher; and (5) controlling said copy unit so as to execute said copy operation dividing into a plurality of times when the set number of copy bundles exceeds said calculated possible number of copy bundles.

8. A method as claimed in claim 7, wherein said step (4) further includes the steps of:

(4-1) obtaining the number of bins required to accommodate the image-copied sheets per copy bundle by dividing the set number of document pages by the number of sheets accommodatable per bin of said finisher; and (4-2) obtaining the possible number of copy bundles by dividing the total number of bins provided to the finisher by the calculated number of bins.

9. A method as claimed in claim 8, wherein said copying apparatus is capable of reading images on both sides of an original document and/or copying on both sides of a copy sheet, and is capable of selecting one of a plurality of copy modes to combine the reading of an original document image and copying to a copy sheet, and wherein said step (3) further includes the steps of:

(3-1) selecting one of said plurality of copy modes;

(3-2) obtaining the number of image-copied sheets per copy bundle from the set number of document pages and the selected copy mode; and (3-3) dividing the calculated number of image-copied sheets by the number of sheets accommodatable per bin of the finisher so as to obtain the number of bins required to accommodate the image-copied sheets per copy bundle.

10. A method as claimed in claim 9, said plurality of copy modes includes a first mode to read images on both sides of an original document and copy said respective images on both respective sides of a single copy sheet, a second mode to read an image on one side of an original document and copy said image on one side of a copy sheet, a third mode to read the images on both sides of an original document and copy said respective images on one side of two respective copy sheets, and a fourth mode to read images on one side of two documents and copy said respective images on both respective sides of a single copy sheet.

11. An image forming apparatus comprising an image forming unit which executes image forming operation of forming images on recording sheets based on images of original document, sorting and ejecting the image-formed recording sheets to a plurality of bins of a sorter incorporated with or connected to said image forming apparatus; and a processing unit which executes processes of i) calculating the number of bins require to accommodate the image-formed recording sheets per image-forming bundle relative to set number of document pages based on the number of sheets accommodatable per bin of said sorter;

ii) calculating possible number of image-forming bundles that can be formed in one image forming operation based on the calculated number of bins and the total number of bins provided to said sorter; and iii) controlling said image forming unit so as to execute said image forming operation dividing into a plurality of times when set number of image-forming bundles exceeds said calculated possible number of image-forming bundles.

12. An image forming apparatus as claimed in claim 11, further comprising a document number setting unit which sets the number of document pages and an image-forming bundle number setting unit which sets the number of image-forming bundles.

13. An image forming apparatus as claimed in claim 11, wherein said processing unit obtains the number of bins required to accommodate the image-formed recording sheets per image-forming bundle by dividing the set number of document pages by the number of sheets accommodatable per bin of said sorter, and obtains the possible number of image-forming bundles by dividing the total number of bins provided to the sorter by said calculated number of bins.

14. An image forming apparatus as claimed in claim 11, further comprising an image reader which reads said original document at a predetermined reading position and an auto document feeder which transports and positions said original document at said reading position.

15. An image forming apparatus as claimed in claim 14, wherein said auto document feeder is of circulation type to retransport the original document read by said image reader at said reading position and position said original document at said reading position again.

16. An image forming apparatus as claimed in claim 11, wherein said image forming apparatus is connected to a network so as to form images on recording sheets based on image data of original document received through the network.

17. A method of controlling an image forming apparatus which executing image forming operation of forming images on recording sheets based on images of original document, sorting and ejecting the image-formed recording sheets to a plurality of bins of a sorter incorporated with or connected to the image forming apparatus, said method comprising the steps of:

(1) calculating the number of bins required to accommodate the image-formed recording sheets per image-forming bundle relative to set number of document pages based on the number of sheets accommodatable per bin of said sorter;

(2) calculating possible number of image-forming bundles that can be formed in one image forming operation based on the calculated number of bins and the total number of bins provided to said sorter; and (3) controlling said image forming apparatus so as to execute said image forming operation dividing into a plurality of times when set number of image-forming bundles exceeds said calculated possible number of image-forming bundles.

18. A method as claimed in claim 17, wherein said step (2) further includes the steps of:

(2-1) obtaining the number of bins required to accommodate the image-formed recording sheets per image-forming bundle by dividing the set number of document pages by the number of sheets accommodatable per bin of said sorter; and (2-2) obtaining the possible number of image-forming bundles by dividing the total number of bins provided to the sorter by said calculated number of bins.

* * * * *